US007607462B2

(12) United States Patent
Degliobizzi

(10) Patent No.: US 7,607,462 B2
(45) Date of Patent: Oct. 27, 2009

(54) SALES PERSON'S TOTE

(76) Inventor: Katherine H. Degliobizzi, 459 Upper Pike Creek Rd., Newark, DE (US) 19711

( * ) Notice: Subject to any disclaimer, the term of this patent is extended or adjusted under 35 U.S.C. 154(b) by 173 days.

(21) Appl. No.: 11/774,279

(22) Filed: Jul. 6, 2007

(65) Prior Publication Data

US 2009/0008004 A1 Jan. 8, 2009

(51) Int. Cl.
*A45C 11/32* (2006.01)
*A45C 1/06* (2006.01)

(52) U.S. Cl. ..... 150/106; 150/112; 150/145; 190/100; 383/106

(58) Field of Classification Search ..... 150/108, 150/112, 113, 106, 131, 145, 147; 190/100–102; 383/106
See application file for complete search history.

(56) References Cited

U.S. PATENT DOCUMENTS

| | | | | |
|---|---|---|---|---|
| 2,599,660 | A * | 6/1952 | Poutinen | 24/601.6 |
| 3,678,977 | A * | 7/1972 | Baumgartner | 150/110 |
| D240,090 | S | 5/1976 | Siegel | |
| 4,139,914 | A * | 2/1979 | Tarr | 2/247 |
| 4,177,587 | A | 12/1979 | Dorsen et al. | |
| 4,236,559 | A * | 12/1980 | Archbold | 224/610 |
| 4,257,463 | A * | 3/1981 | Monaco | 150/111 |
| 4,895,198 | A | 1/1990 | Samuelson et al. | |
| D325,126 | S | 4/1992 | Costello | |
| 5,215,379 | A | 6/1993 | Pickard et al. | |
| 5,402,869 | A * | 4/1995 | Saltzman et al. | 190/108 |
| D375,629 | S | 11/1996 | Chen | |
| 5,586,706 | A * | 12/1996 | Ritzenhein | 224/671 |
| D380,087 | S | 6/1997 | Roth | |
| D380,607 | S | 7/1997 | Leben | |
| D393,366 | S | 4/1998 | Kopel | |
| D396,554 | S | 8/1998 | Roeder | |
| 5,829,657 | A | 11/1998 | Romer, Jr. | |
| 5,941,437 | A * | 8/1999 | Okumura | 224/585 |
| 6,092,661 | A * | 7/2000 | Mogil | 206/579 |
| 6,126,012 | A | 10/2000 | Roegner | |
| 6,135,179 | A | 10/2000 | Joyner | |
| 6,174,082 | B1 | 1/2001 | Pelky et al. | |
| 6,220,318 | B1 | 4/2001 | Pinti | |
| 6,279,747 | B1 * | 8/2001 | Zegarra | 206/579 |
| D465,323 | S | 11/2002 | Dancyger | |
| 6,626,601 | B1 | 9/2003 | Moor et al. | |
| 6,681,972 | B1 | 1/2004 | Tapocik | |
| 6,766,932 | B2 | 7/2004 | Hansen et al. | |
| 6,862,827 | B2 | 3/2005 | Gregory | |

(Continued)

*Primary Examiner*—Sue A Weaver
(74) *Attorney, Agent, or Firm*—Connolly Bove Lodge & Hutz LLP

(57) ABSTRACT

A carryall or tote is a bag with an open top end that communicates with at least one inner pouch volume. The open top end is closed with a releasable closure. A transparent pocket located upon the front outer surface of the bag holds an accessory, such as an electronic access key or electronic access unit to permit real estate agents to access real properties listed for sale. A back pocket located upon the back outer surface holds one or more business cards or other identification indicia. A length-adjustable neck strap is provided from which the bag may be suspended. Alternatively, the bag may be suspended by one or more belt engaging loops. In some embodiments, a pen pocket may be provided as well as an additional pouch that is releasably fastened to the bag to hold other accessories.

17 Claims, 4 Drawing Sheets

U.S. PATENT DOCUMENTS

| | | | | |
|---|---|---|---|---|
| D504,230 | S | 4/2005 | Thomas | |
| 6,974,157 | B1 * | 12/2005 | Hammon | 281/15.1 |
| D520,234 | S | 5/2006 | Schmitt | |
| 7,198,083 | B1 | 4/2007 | Sartena | |
| 2001/0027834 | A1 * | 10/2001 | Southwick | 150/108 |
| 2003/0188815 | A1 | 10/2003 | Hart | |
| 2003/0213826 | A1 | 11/2003 | Jacobs | |
| 2004/0020813 | A1 * | 2/2004 | Moeller et al. | 206/425 |
| 2004/0188299 | A1 * | 9/2004 | Vaira et al. | 206/424 |
| 2006/0086014 | A1 | 4/2006 | Plank et al. | |
| 2006/0233465 | A1 * | 10/2006 | Moore | 383/6 |

* cited by examiner 10
10
10
20
20
22
22
22
12
15
18
16
18
14

SALES PERSON'S TOTE

BACKGROUND OF THE INVENTION

1. Field of the Invention

This invention relates to a carryall or tote capable of being suspended from a user's neck or attached to a user's belt. The carryall has an external, transparent front pocket to hold an electronic key unit, or similar device, and one or more external rear pockets, such as to hold business cards and/or writing implements. The carryall or tote is especially adapted for use by real estate agents or other sales persons.

2. Description of the Prior Art

U.S. Pat. No. 5,829,657 illustrates a ticket stub display device and article carrier. The carrier is a pouch with a top opening and a suspending structure (loop) connected to the body of the pouch. The carrier may be worn around a user's neck and suspended by the suspending structure. An envelope structure associated with the carrier defines a transparent front pocket through which a ticket stub inserted therein may be visible.

U.S. Pat. No. 6,862,827 illustrates a holder for carrying and displaying a travel-related documents. The holder has at least one transparent pocket where a document placed therein is easily accessible by the user and easily viewed by third parties. The holder may be worn about a user's neck or shoulder with a lanyard directly attached to the document holder, or on a belt or other object by means of a clip.

U.S. Pat. No. 6,681,972 illustrates a foldable holder for travel documents where the documents can be easily verified and removed by a ticket agent or security officer while being worn around the neck of a user by a permanently or removably affixed strap or cord. The holder has at least one clear plastic sleeve attached to the front surface of the holder so that an agent can see what is inside the sleeve, such as a photo-ID. The holder can be designed to be folded and retained shut by closure means. Interior pockets can be provided to retain personal items.

A carryall or tote designed to be worn about the neck that permits immediate access to one or more security accessories, identification indicia and an electronic access unit or key device has not been disclosed. Such carryall would have specific application for sales persons, particularly for real estate agents.

SUMMARY OF INVENTION

In a first aspect of the invention, a carryall or tote is a bag defining at least one inner pouch volume. The bag has a front outer surface, a back outer surface, at least two side portions, an open top end and a releasable closure for closing said open top end. A transparent pocket is located upon the front outer surface. The transparent pocket has an open top end and is particularly adapted to hold an accessory, such as an electronic access unit or electronic key frequently used by real estate agents. A back pocket is located upon the back outer surface of the bag and is particularly adapted to hold one or more business cards or other identification indicia. A length-adjustable neck strap is provided from which the bag may be suspended. The neck strap may be releasably engageable to or joined to the bag. In this way, the sales person may have ready access to the accessory while maintaining the carryall or tote in a suspended position around the neck.

It may be advantageous to include a pen pocket upon either the front outer surface or the back outer surface of the bag to hold a writing implement. In addition, one or more rings may be attached to either one of said side portions to enable a pouch for holding additional accessories or a key ring to be releaseably engaged to the side of the bag. Yet further, one or more adjustable belt loops may be positioned on the outer surface of the back portion of the bag to provide an alternate means for securing the bag to the sales person.

A second aspect of the invention is a method for organizing accessories of sales agents inside a single carryall or tote. In such method, an electronic key device is stored in an outer transparent front pocket of a bag, wherein said bag further defines an internal volume and has a top closure and a length-adjustable neck strap from which the bag may be suspended. Alternatively, said bag may be releasably attached to a belt or clothing item by belt loops. In addition, at least one business card or other identification indicia is stored in a first outer back pocket of said bag. A writing implement may be stored in a second outer pocket of the bag. Other accessories may be stored within the internal bag volume or in a separate pouch releasably attachable to said bag. Accessories may include a can of mace, a cigarette lighter, a flashlight, more or more keys, additional writing implements, currency, credit cards, cosmetics, cellular telephone, personal desk assistant, and the like.

DETAILED DESCRIPTION OF THE INVENTION

Figures 1, 2, 3:
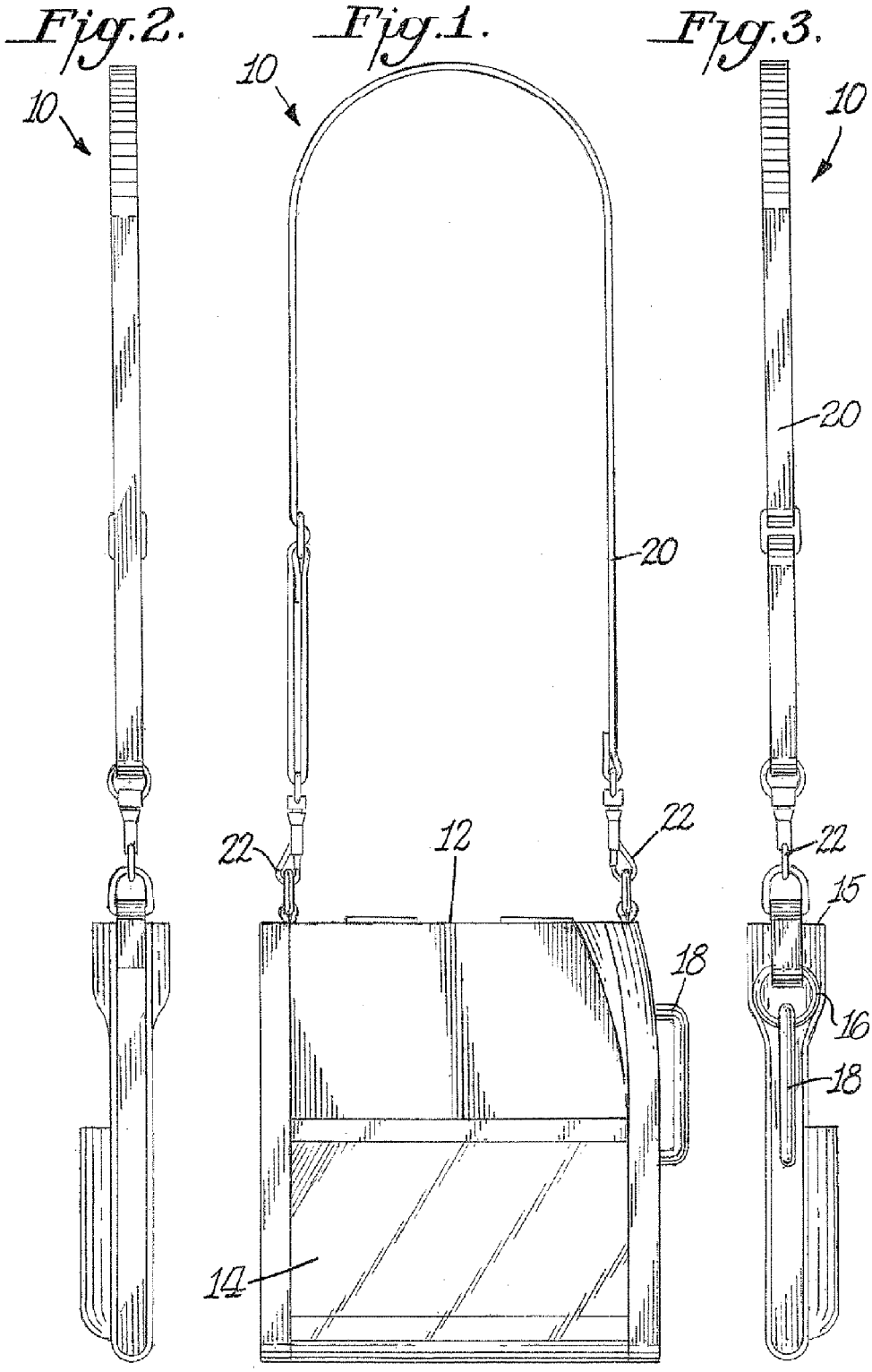
FIG. 1 is a front elevational view of a sales person's carryall or tote according to the invention.
FIG. 2 is a left side elevational view of the carryall of FIG. 1.
FIG. 3 is a right side elevational view of the carryall of FIG. 1.
Figure 4:
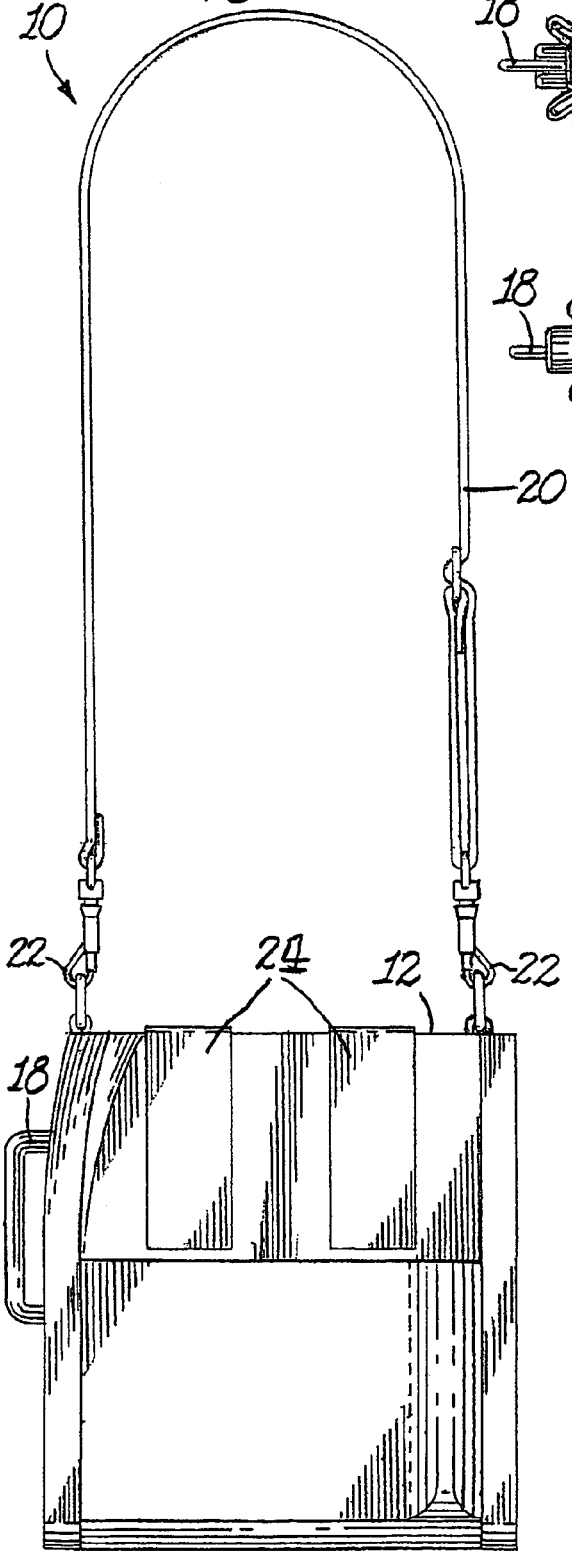
FIG. 4 is a rear elevational view of the carryall of FIG. 1.
Figure 5:
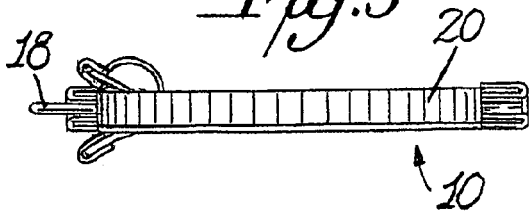
FIG. 5 is a top plan view of the carryall of FIG. 1.
Figure 6:
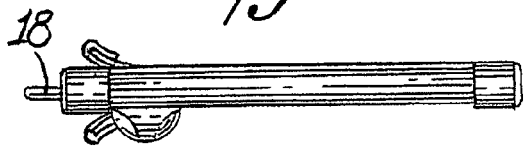
FIG. 6 is a bottom plan view of the carryall of FIG. 1.

Sales persons, particularly real estate agents, frequently are required to travel to customer locations, inventory locations or listed properties. They regularly enter and exit locked buildings with clients or customers. Essential accessories to perform this job include keys or access devices, identification indicia, such as business cards, communications devices, such as cellular telephones or personal desk assistants with e-mail access, and writing implements. It is important to have many or all of these essential accessories upon their person and available for quick access while performing their job. It is important further to have certain of these essential accessories visible for immediate access.

Real estate agents frequently use a coded electronic key unit that allows them to unlock a lock box to reveal a house key or unlock another portal to permit entry into a listed real estate property. Real estate agents also need ready access to business cards to distribute to potential buyers and sellers. Business cards also frequently are left at homes viewed during real estate tours as a courtesy to the seller. In addition, real estate agents need ready access to writing implements to facilitate remembering or transmitting information pertinent to a prospective real estate property or transaction. Safety is another concern, and ready access to car keys, home keys and safety accessories such as mace and a flashlight will also be important.

FIGS. 1-6 show a tote or carryall 10 intended to be used by sales persons, such as real estate agents. The tote 10 comprises a bag portion 12 with a transparent front pocket 14 on the outside front surface of the tote with an opening at the top 15. The bag portion 12 can be formed with any durable fabric, such as, for example, a medium gauge nylon rip stop material or a canvas material or other fabric suitable for handbags or luggage. The bag portion 12 also may be formed from leather or other leather substitutes (e.g., vinyl) suitable for handbags or luggage. The bag portion 12 may define one or multiple interior compartments in which to store accessories.

The transparent front pocket 14 may be sewn or attached integrally with the outside front surface of tote 10. Alternatively, although less preferred, the transparent front pocket 14 may be detachably attached to the outside front surface of the tote 10, such as by hook and loop fasteners. The front pocket may be formed with a sheet of a medium gauge clear vinyl polyvinylchloride (PVC), or alternative clear polymeric material.

The tote or carryall 10 can be worn around the neck of a user by a length-adjustable neck strap 20 that can be permanently attached (not shown in FIGs.) or can be detachably connected to the bag 12 by spring clips 22 (see FIGS. 1-4). Spring clips 22 may be metal or durable plastic generally suitable to withstand repeated fastening and unfastening. The neck strap 20 may be comprised of a woven or non woven material, such a woven or nonwoven polyester. A side ring 16 is attached on one side of the bag 12 to which a clip 18 is further attached. Such ring may be a metal ring or plastic ring, and may be a regular circle or a "D-ring" or any alternative ring-like shape. On the outside back surface of the bag 12 are two belt loops 24 (see FIG. 4). Also on the outside back surface of the bag 12 is a pen pocket 26 with a top opening 28 and a back pocket 30 with a top opening 32.

In one optimum embodiment, the bag 12 is between about 5 and 6 inches wide, about six to seven inches high and about one half to three-quarters inches deep. The inner volume of the bag 12 may be subdivided into any number and arrangement of interior compartments. Such interior compartments may store one or multiple accessories such as cosmetics, credit cards, currency, grooming aids, personal desk assistants, cell phones, calendars, and the like. In this optimum embodiment, the user has ready access to the interior compartments in part because there is no flap or other material over the open top 15 of the bag.

Figure 7:
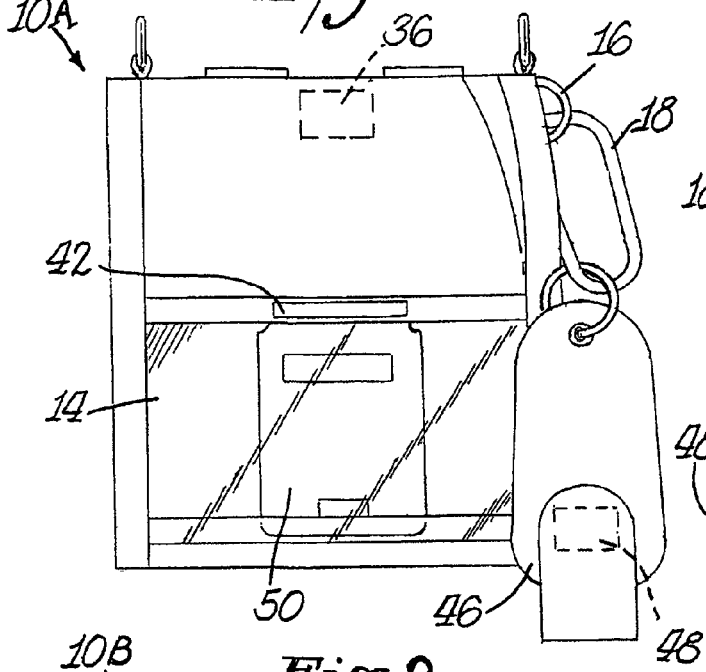
FIG. 7 is a front elevational view of an alternative embodiment of a sales person's carryall or tote showing accessories stored therein.
Figure 8:
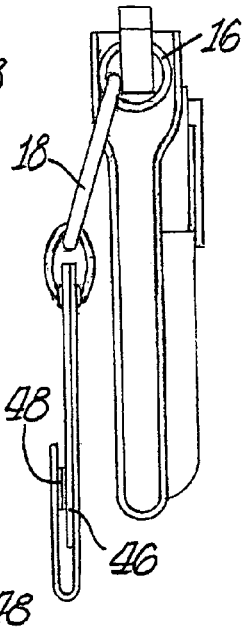
FIG. 8 is a right side elevational view of the carryall of FIG. 7.

FIGS. 7-8 show a front- and side-view, respectively, of one alternate embodiment of the tote 10A. An electronic key unit 50 is held within the transparent front pocket 14 and a logo strip 42, meant to display a logo or trademark, is located above the transparent front pocket 14 and preferably is attached to the outer front surface of the tote 10A.

Referring to FIG. 7, the transparent front pocket 14 is sized to receive an electronic key unit 50. The key unit 50 may be removed from the transparent front pocket 14 for use, or may be operable while held within the transparent front pocket 14.

This embodiment includes a small pouch 46 attached to the clip 18. In the illustrated embodiment (FIGS. 7-8), the small pouch 46 has a hook and loop closure 48 to keep an item secured within, such as a mace container, a lighter, a flashlight or one or more keys (not shown).

Figure 11:
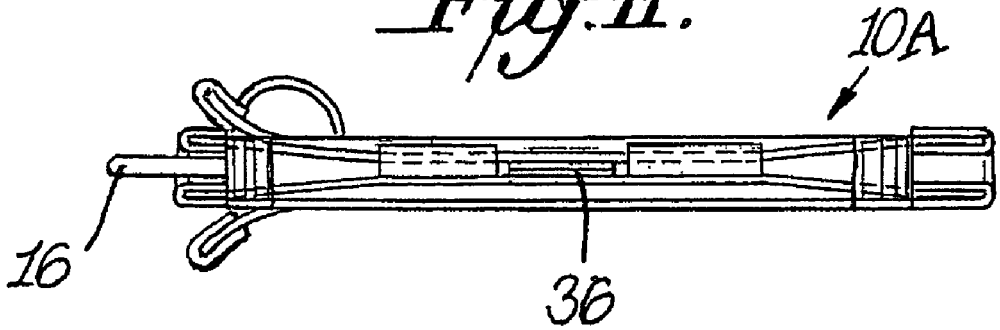
FIG. 11 is a top plan view of the tote of FIG. 7 with a neck strap broken away to show a hook and loop closure of a center compartment of the carryall.

FIG. 11 shows a top view of the carryall 10A. In FIG. 11, a hook strip and a loop strip for a hook and loop closure 36 are affixed on the upper, inside front surface and upper, inside back surface of the bag 12. By connecting the strips, the inner volume of the carryall 10A can be releasably closed. Alternative fasteners may be used to releasably close the bag 12, such as one or more buttons, snaps, magnetic snaps, releasable clips, or the like. While the carryall 10A operates satisfactorily without a top closure 36, many users prefer to have some closure means associated with the carryall 10A for greater security.

Figure 9:
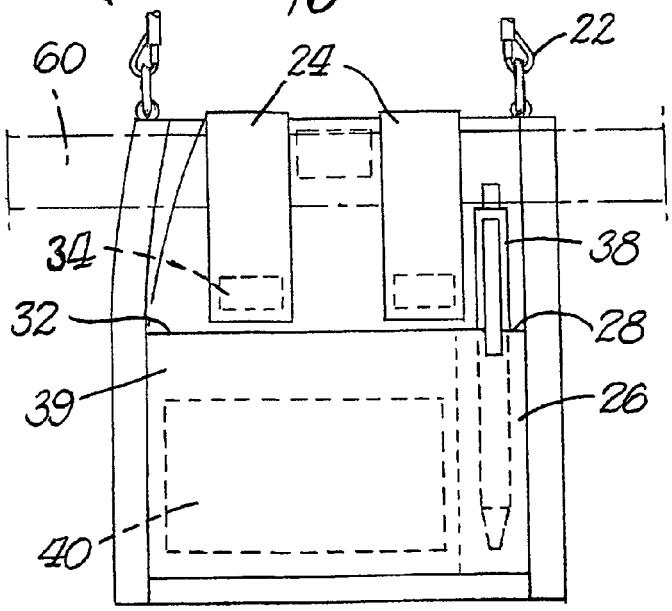
FIG. 9 is a rear elevational view of the carryall of FIG. 7.
Figure 10:
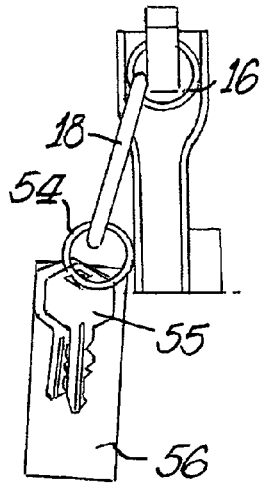
FIG. 10 is a fragmental right side elevational view showing keys attached to a clip of the carryall or tote of FIG. 7.

Referring to FIGS. 9-10, another alternate embodiment of the carryall or tote 10R is shown. In this embodiment, the back pocket 39 is sized to receive one or more identification indicia 40, such as business cards (shown in phantom outline). The belt loops 24 are attached over a belt 60 (shown in phantom outline) by fastening mating hook and loop fasteners 34 (shown in phantom outline). A writing implement 38 (an ink pen) is held partially within the pen pocket 28.

FIG. 10 shows a side view of the carryall 10B. In this embodiment a key ring 54 holding keys 55 and a key ID card 56 are removably attached to the clip 18. In addition to keys, many alternative accessories may be clipped onto the bag 12 at clip 18 to provide ready access.

While the invention has been described in connection with what is presently considered to be the most practical and preferred embodiments, it is understood that the invention is not limited to the disclosed embodiments, but, on the contrary, is intended to cover various modifications and equivalent arrangements included within the spirit and scope of the appended claims.

What is claimed:

1. A carryall for a real estate agent, comprising:

a bag defining at least one inner pouch volume, said bag having a front outer surface, a back outer surface, at least two side portions, an open top end and a releasable closure for closing said open top end, said bag having dimensions of about 5 to 6 inches wide, about six to seven inches high and about one half to three-quarters inches deep;

a transparent pocket of a sheet of polymeric material located upon the front outer surface, said transparent pocket having an open top end;

a real estate agent's electronic key access device within the transparent pocket and operable while held therein;

a back pocket located upon the back outer surface, said back pocket having an open top end; and a length-adjustable neck strap from which the bag may be suspended, wherein said strap is releasably attachable to said bag.

2. The carryall of claim 1, further comprising a pen pocket located upon either the front outer surface or the back outer surface and sized to hold a writing implement.

3. The carryall of claim 1, further comprising a ring attached to either one of said side portions.

4. The carryall of claim 1, further comprising fasteners attached to end portions of said length-adjustable neck strap to releaseably join said neck strap to said bag.

5. The carryall of claim 1, further comprising at least one adjustable belt loop on the outer surface of the back portion with a bottom end of each said loop being releasably attached to the back outer surface.

6. The carryall of claim 1, further comprising one or more business cards within the back pocket.

7. The carryall of claim 3, further comprising a pouch attached to said ring, said pouch so dimensioned to hold an accessory.

8. The carryall of claim 7, wherein the accessory is selected from the group consisting of a mace can, a lighter, a flashlight and one or more keys.

9. The carryall of claim 3, further comprising a key ring attached to said ring.

10. The carryall of claim 1, wherein said bag defines a plurality of internal compartments within the inner pouch volume.

11. A method for organizing accessories of sales agents inside a single carryall, comprising:

removably storing an electronic key device of a sales agent in an outer transparent front pocket of a bag with said electronic key device visible through a sheet of polymeric material forming the transparent front pocket, said bag defining an internal volume for storing one or more items and having a top closure, said bag further defining a first outer back pocket, and having a length-adjustable neck strap from which the bag may be suspended, and said bag having dimensions of about 5 to 6 inches wide, about six to seven inches high and about one half to three-quarters inches deep;

unlocking a lock with said electronic key device while said electronic key device is stored in the transparent front pocket; and removably storing at least one business card or other identification in the first outer back pocket of said bag.

12. The method of claim 11, further comprising removably storing a writing implement in a second outer pocket of said bag.

13. The method of claim 11, further comprising removably storing at least one item inside the internal volume of said bag.

14. The method of claim 11, further comprising removably storing an accessory in a separate pouch releasably attachable to said bag.

15. The method of claim 14, wherein the accessory comprises an accessory selected from the group consisting of: a mace can, a lighter, a flashlight, and one or more keys.

16. The method of claim 11, further comprising releasably attaching a key ring on at least one side of said bag.

17. The method of claim 11, further comprising holding said bag in place with one or more one or more belt engaging fasteners provided on a surface of the bag.

* * * * *